US008436691B2

(12) United States Patent
Hsieh et al.

(10) Patent No.: US 8,436,691 B2
(45) Date of Patent: May 7, 2013

(54) SIGNAL TRANSMISSION APPARATUS

(75) Inventors: Po-Chuan Hsieh, Taipei Hsien (TW); Yu-Chang Pai, Taipei Hsien (TW); Shou-Kuo Hsu, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 647 days.

(21) Appl. No.: 12/620,558

(22) Filed: Nov. 17, 2009

(65) Prior Publication Data

US 2011/0025434 A1 Feb. 3, 2011

(30) Foreign Application Priority Data

Jul. 30, 2009 (CN) ..... 2009 1 0305017

(51) Int. Cl.
*H01P 3/08* (2006.01)
*H01P 1/203* (2006.01)

(52) U.S. Cl.
USPC ..... 333/4; 333/204

(58) Field of Classification Search ..... 333/4, 5, 333/26, 156, 161, 33, 204, 205, 238, 246
See application file for complete search history.

(56) References Cited

U.S. PATENT DOCUMENTS 2,411,555 A 11/1946 Rogers
3,015,081 A * 12/1961 Ayer et al. ..... 333/246
6,603,376 B1 * 8/2003 Handforth et al. ..... 333/238
6,822,534 B2 * 11/2004 Uriu et al. ..... 333/185
7,830,221 B2 * 11/2010 Merritt ..... 333/1
7,911,288 B1 * 3/2011 Bokhari ..... 333/1
2008/0258838 A1 * 10/2008 Oshima ..... 333/25

* cited by examiner

*Primary Examiner* — Benny Lee
*Assistant Examiner* — Gerald Stevens
(74) *Attorney, Agent, or Firm* — Altis Law Group, Inc.

(57) ABSTRACT

A signal transmission apparatus includes two circuit layers. First and second ground sheets each has a rectangular area are arranged in the two circuit layers respectively. A third ground sheet is arranged between the two circuit layers. A differential pair includes a transmission line arranged between the first and third ground sheets and a transmission line arranged between the second and third ground sheets. The first to third ground sheets have same electric potential. Projections of the two rectangular areas on a surface where the third ground sheet in only have one common border with the third ground sheet. The third ground sheet is formed by extending the common border along a signal transmission direction. The differential pair includes a number of section pairs each composed of two sections arranged in the two transmission lines symmetrically. Every two adjacent section pairs are equivalent to a capacitor and an inductor.

6 Claims, 7 Drawing Sheets

SIGNAL TRANSMISSION APPARATUS

BACKGROUND

1. Technical Field

The present disclosure relates to signal transmission systems, and particularly to a signal transmission apparatus used in a signal receiver or a signal transceiver of a wireless transmission system.

2. Description of Related Art

Wireless transmissions are widely used in communications and networks. Consequently, electronic devices can be moved freely without limitations of wires when transmitting signals. In a wireless transmission system, a signal for transmission is modulated by a high frequency carrier in a signal transceiver to generate a radio frequency signal. The radio frequency signal is transmitted to a signal receiver via air, and is demodulated into the signal for transmission in the signal receiver. Bad signal quality may be induced if signal transmission paths of the radio frequency signal in the signal transceiver and the signal receiver are improperly designed.

DETAILED DESCRIPTION

Figure 1:
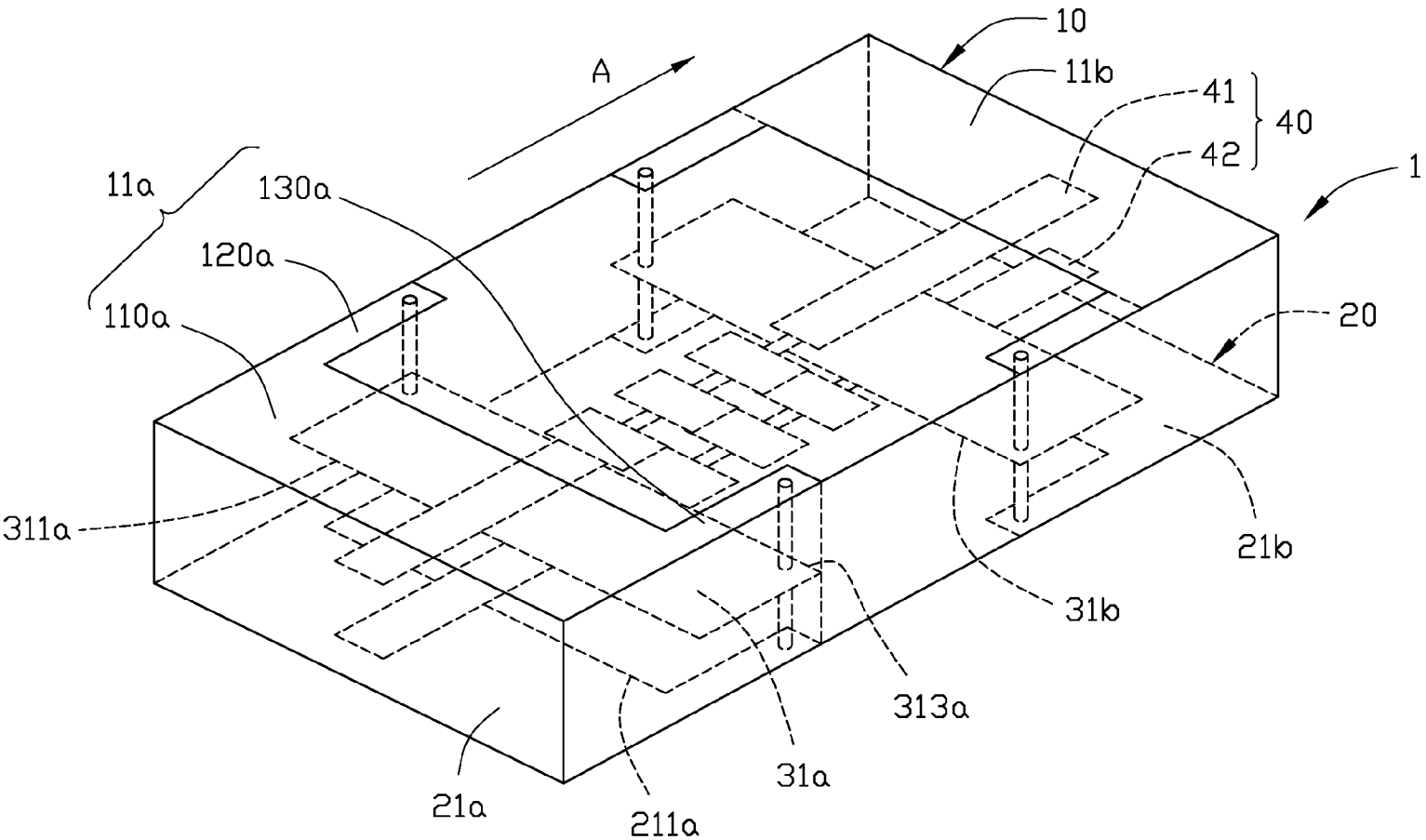
FIG. 1 is an isometric view of a signal transmission apparatus according to an embodiment of the present disclosure, wherein the signal transmission apparatus includes a low pass filter, the low pass filter includes a plurality of section pairs of a differential pair.
Figure 2:
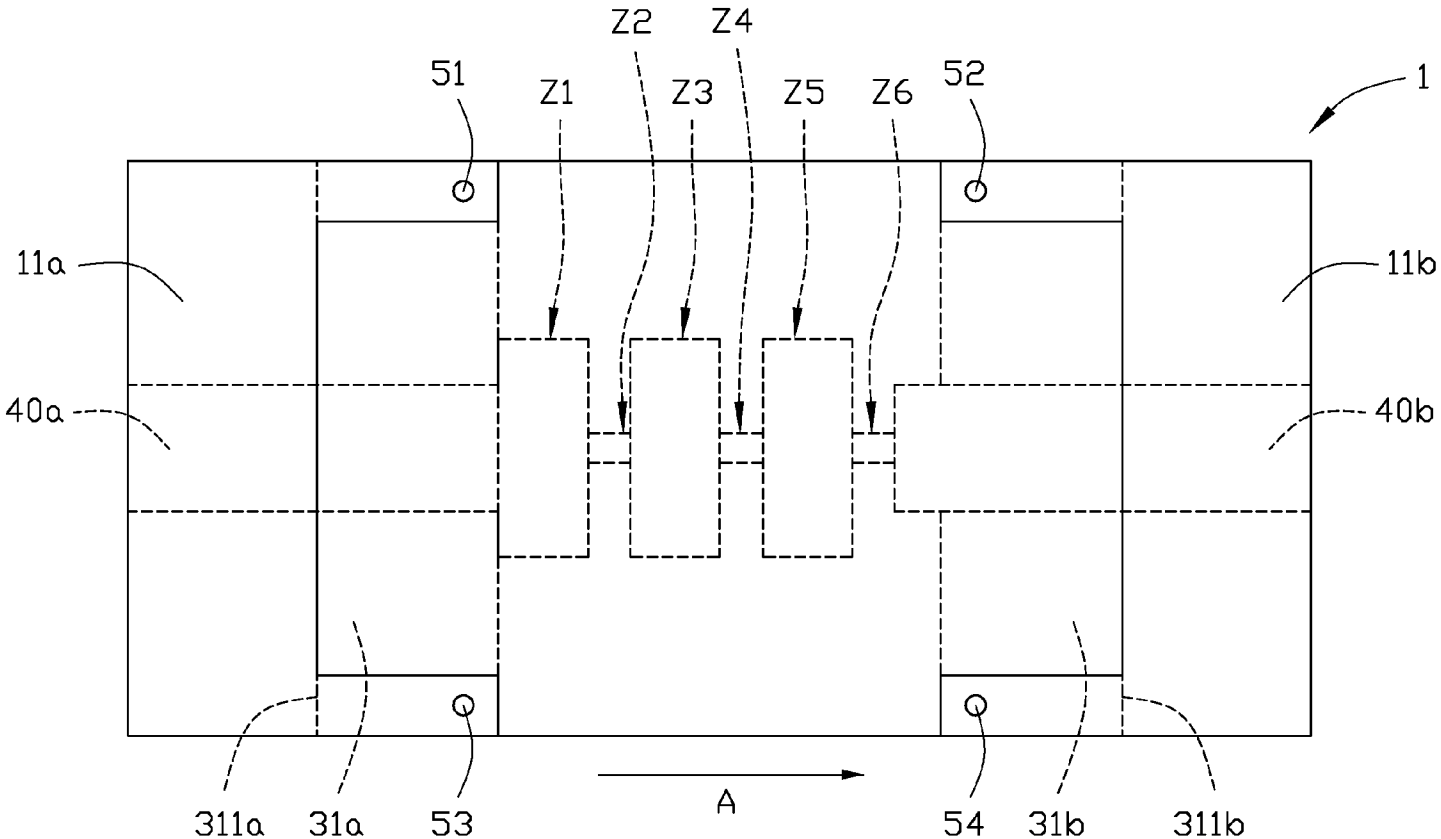
FIG. 2 is a top view of the signal transmission apparatus of FIG. 1.
Figure 3:
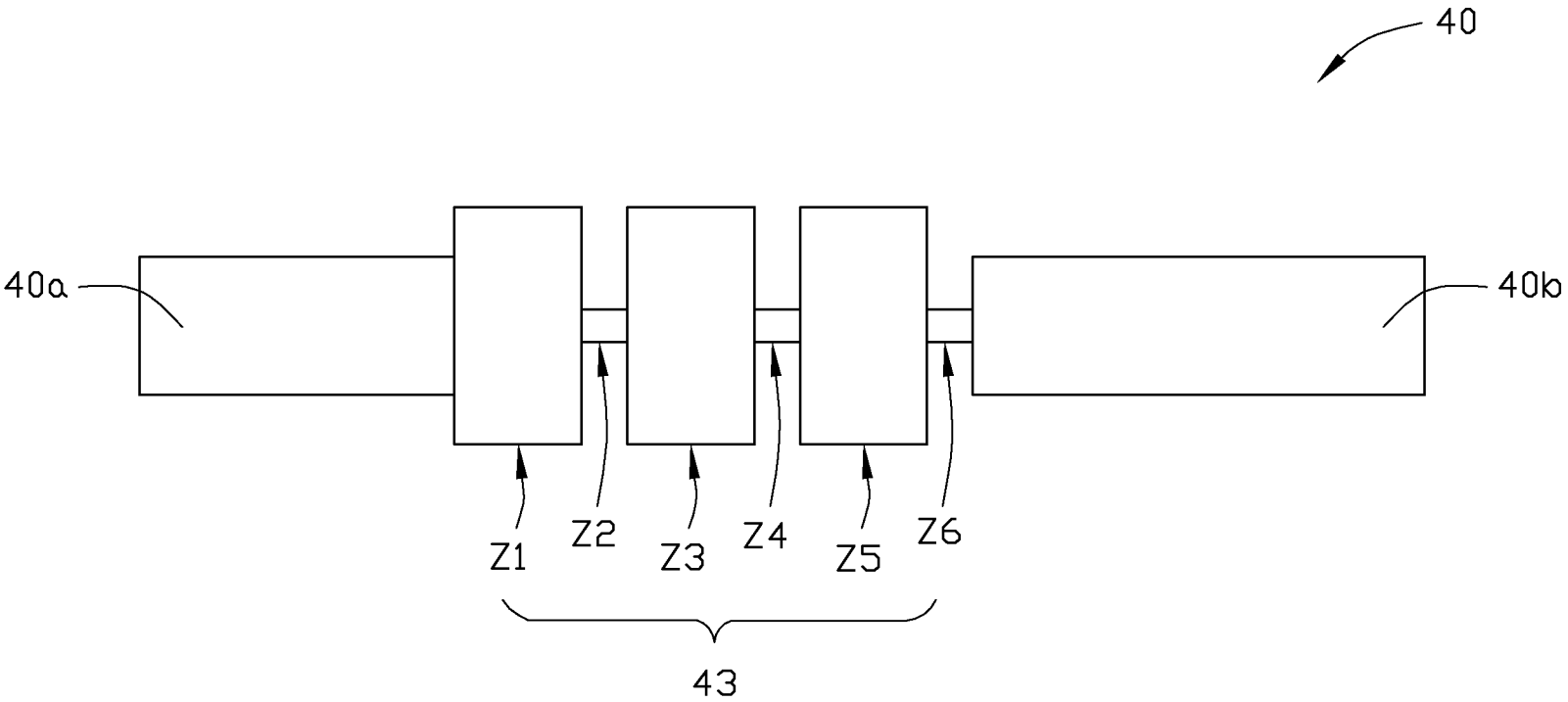
FIG. 3 is a top view of the low pass filter of FIG. 1, in which two sections in each of the section pairs are in mirror image.

Referring to FIGS. 1 to 3, an embodiment of a signal transmission apparatus 1 is used in a printed circuit board. The apparatus 1 includes six ground sheets 11*a*, 11*b*, 21*a*, 21*b*, 31*a*, 31*b*, a differential pair 40, and four through holes 51, 52, 53, and 54. The ground sheets 11*a*, 11*b*, 21*a*, 21*b*, 31*a*, and 31*b* are parallel to each other. The ground sheets 11*a* and 11*b* are arranged in a first circuit layer 10. The ground sheets 21*a* and 21*b* are arranged in a second circuit layer 20. There is glass fiber epoxy resin (FR-4) material arranged between the first and second circuit layers 10 and 20. The ground sheets 31*a* and 31*b* are arranged in the FR-4 material between the first and second circuit layers 10, 20. The ground sheets 31*a* and 31*b* are symmetrically arranged on a common surface.

The ground sheets 11*a*, 11*b*, 21*a*, 21, 31*a*, and 31*b* are made of conductive material, such as copper. Each of the ground sheets 11*a*, 11*b*, 21*a*, and 21*b* is a "U" shaped structure.

The ground sheet 11*a* includes a rectangular area 110*a*, and two areas 120*a*, 130*a* extended toward the ground sheet 11*b* from two opposite sides of the rectangular area 110*a* respectively. Each of the ground sheets 11*b*, 21*a*, and 21*b* also includes a rectangular area and two extended areas. The ground sheets 11*a* and 11*b* are arranged symmetrically in the first circuit layer 10. The ground sheets 21*a* and 21*b* are arranged symmetrically in the second circuit layer 20. Projections of the ground sheets 11*a* and 21*a* on the second circuit layer 20 superpose the ground sheets 21*a* and 21*b* respectively.

The ground sheets 31*a* and 31*b* are rectangular in shape. Projections of the rectangular areas of the ground sheets 11*a* and 21*a* on the ground sheet 31*a* superpose a border 311*a* of the ground sheet 31*a*. The ground sheet 31*a* is formed by extending the border 311*a* along a signal transmission direction indicated by the arrow A of FIGS. 1 and 2. Similarly, projections of the rectangular areas of the ground sheets 11*b* and 21*b* on the ground sheet 31*b* superpose a border 311*b* of the ground sheet 31*b*. The ground sheet 31*b* is formed by extending the second common border 311*b* along a direction opposite to the signal transmission direction.

The through hole 51 vertically passes through the extended area 120*a*, the ground sheet 31*a* and the corresponding extended area of the ground sheet 21*a*. The through hole 53 vertically passes through the extended area 130*a*, the ground sheet 31*a* and the other extended area of the ground sheet 21*a*. Each of the through holes 52 and 54 vertically passes through a corresponding extended area of the ground sheet 11*b*, the ground sheet 31*b* and a corresponding extended area of the ground sheet 21*b*. The ground sheets 11*a*, 21*a*, and 31*a* are conductively connected by the through holes 51 and 53. The ground sheets 11*b*, 21*b*, and 31*b* are conductively connected by the through holes 52 and 54. Therefore, the ground sheets 11*a*, 21*a*, and 31*a* have same electric potentials. The ground sheets 11*b*, 21*b*, and 31*b* have same electric potentials. In this embodiment, the ground sheets 11*a*, 11*b*, 21*a*, 21*b*, 31*a*, and 31*b* have same electric potentials.

The differential pair 40 transmits differential signals along the signal transmission direction A, and are parallel to the ground sheets 11*a*, 11*b*, 21*a*, 21*b*, 31*a*, and 31*b*. The differential pair 40 includes two transmission lines 41 and 42. The transmission line 41 is arranged between the first circuit layer 10 and the common surface of the ground sheets 31*a*, 31*b*. The transmission line 42 is arranged between the second circuit layer 20 and the common surface of the ground sheets 31*a*, 31*b*. A first vertical distance between the transmission line 41 and the ground sheet 31*a* is equal to a second vertical distance between the transmission line 42 and the ground sheet 31*a*. A third vertical distance between the transmission line 41 and the ground sheet 11*a* is equal to a fourth vertical distance between the transmission line 42 and the ground sheet 21*a*. The first to fourth vertical distances are all equal. A horizontal distance between the through hole 51 and the differential pair 40 is equal to a horizontal distance between each of the through holes 52-54 and the differential pair 40. In this embodiment, an input terminal 40*a* of the differential pair 40 is arranged between the ground sheets 11*a* and 21*a*, and an output terminal 40*b* of the differential pair 40 is arranged between the ground sheets 11*b* and 21*b*.

The differential pair includes a plurality of section pairs arranged between the input terminal 40*a* and the output terminal 40*b*. Each section pair includes a section arranged in the transmission line 41 and a section arranged in the transmission line 42. The two sections of each section pair are symmetrical with one another. Every two adjacent sections arranged in each of the transmission lines 41 and 42 are different in width.

Figure 4:
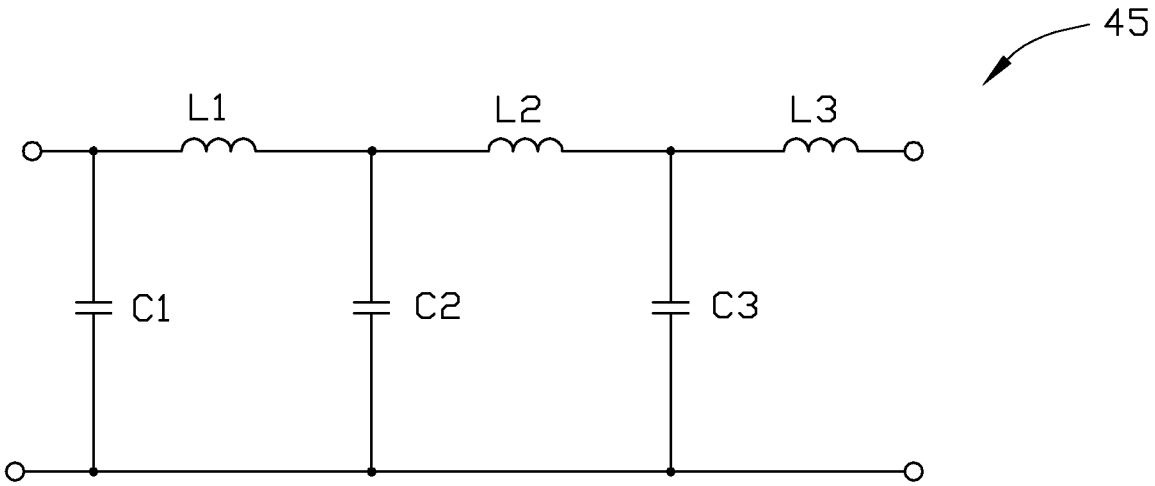
FIG. 4 is an equivalent circuit diagram of the low pass filter of FIG. 1.
Figure 5:
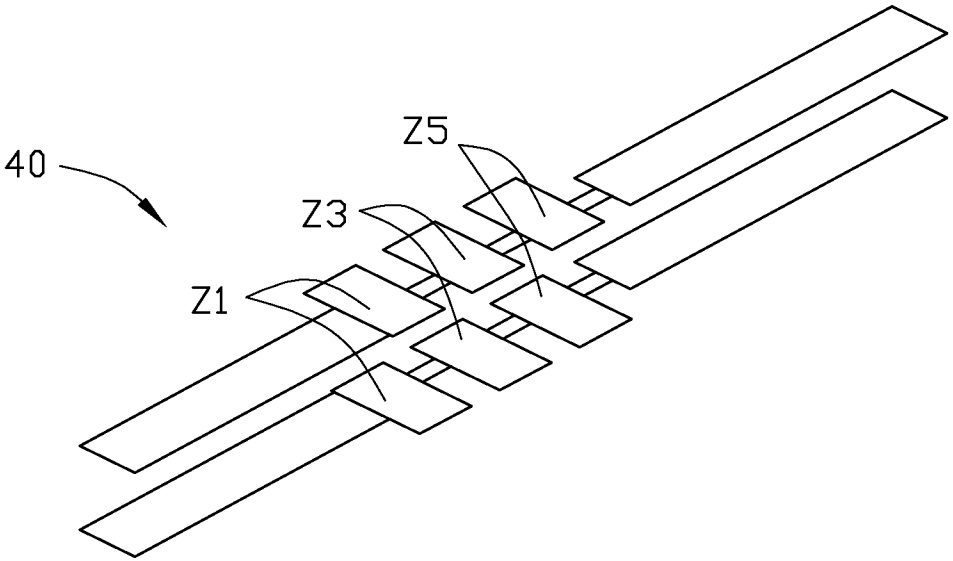
FIG. 5 shows another embodiment of the low pass filter of FIG. 1, in which there is a relative horizontal displacement between the two sections in some of the section pairs.

Referring to FIGS. 4-5, it is known in the art that both inductance and capacitance of a transmission line are related to the width of the transmission line; the inductance increases with decreasing line width, and the capacitance increases with increasing line width. Therefore, the section pairs which have wide line width function as capacitors, and section pairs which have narrow line width function as inductors. All of the section pairs form a low pass filter. The number of the section pairs is chosen by required specifications of the low pass filter. As illustrated in this embodiment, the differential pair 40 includes six section pairs Z1-Z6, which are designed according to a filter 45 as shown in FIG. 5.

The filter 45 includes three capacitors C1-C3 and three inductors L1-L3. The section pairs Z1, Z3, and Z5 are equivalent to the three capacitors C1-C3 respectively. The section pairs Z2, Z4, and Z6 are equivalent to the three inductors L1-L3 respectively. The line width of each section of each of the section pairs Z1-Z6 is determined by parameters of a corresponding equivalent capacitor or inductor. The parameters may include a capacitance of each of the capacitors C1-C3 correspondingly or an inductance of each of the inductors L1-L3.

The signal transmitted by the differential pair 40 is firstly affected by rectangular areas 110*a*, 120*a* of the ground sheets 11*a*, 21*a*. After that, the signal is affected by the ground sheet 31*a*. Because the ground sheet 11*a*, 21*a*, and 31*a* have the same electric potential, and projections of the rectangular area 110*a* and the rectangular area of the ground sheet 21*a* on the ground sheet 31*a* only have one common border with the ground sheet 31*a*, a continuous characteristic impedance of the differential pair 40 is obtained. Therefore, common mode noise is reduced during signal transmission. A signal with reduced noise is further filtered by the low pass filter formed by the section pairs Z1-Z6. As a result, signal transmission quality of the differential pair 40 is improved.

The transmission lines 41 and 42 are arranged at initial positions as shown in FIG. 3 that the transmission line 41 mirrors the transmission line 42. A frequency bandwidth of the differential pair 40 can be adjusted by changing a coupling capacitance between the sections of each of the section pairs Z1, Z3, and Z5. The coupling capacitance can be adjusted by moving the two sections of each of the section pairs Z1, Z3, and Z5 along the width of the transmission lines oppositely, from the initial positions respectively. In other words, the projection of the sections Z1, Z3, and Z5 of the transmission line 41 on the transmission line 42 is not superposed with the sections Z1, Z3, and Z5 of the transmission line 42.

Figure 6:
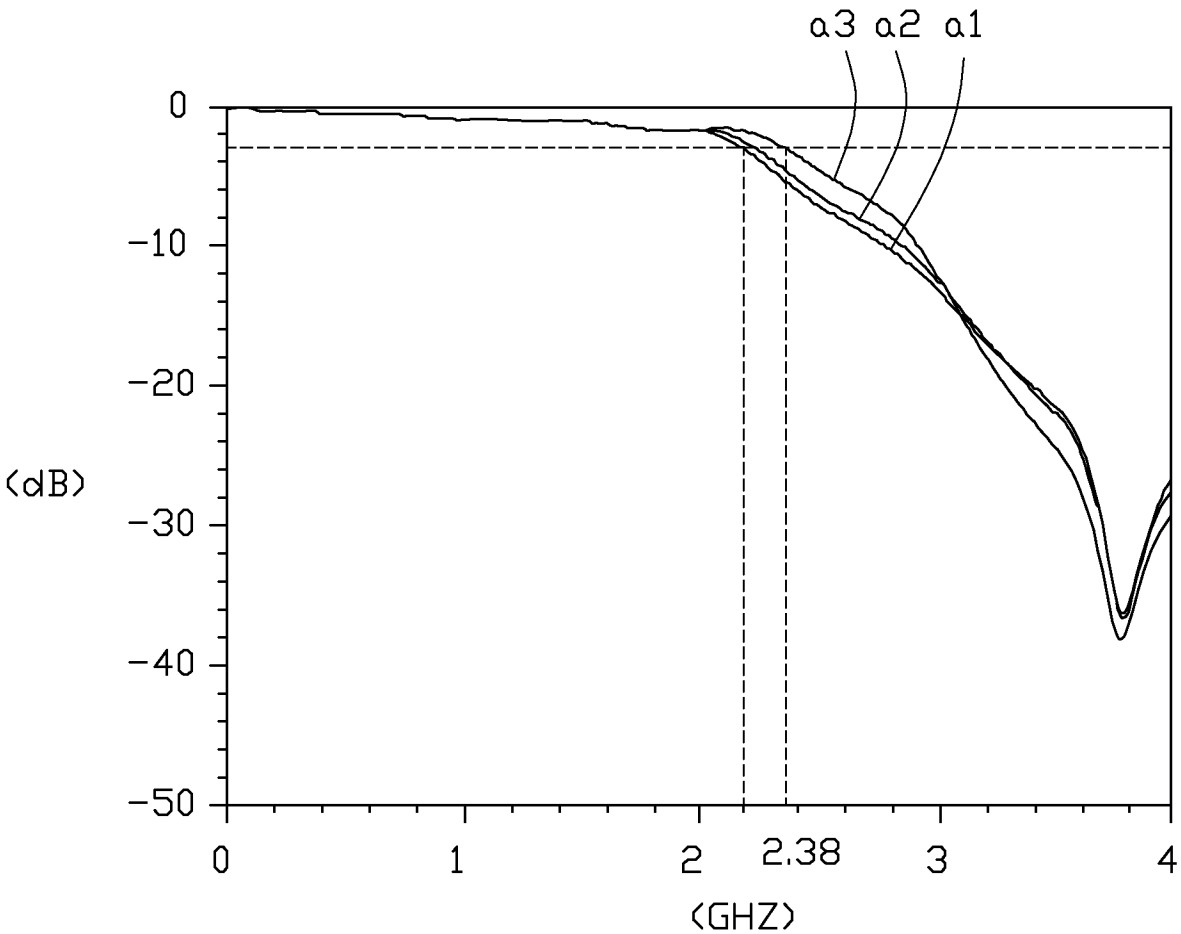
FIG. 6 is a simulation graph of insertion loss of a difference-mode input for the signal transmission apparatus of FIG. 1.
Figure 7:
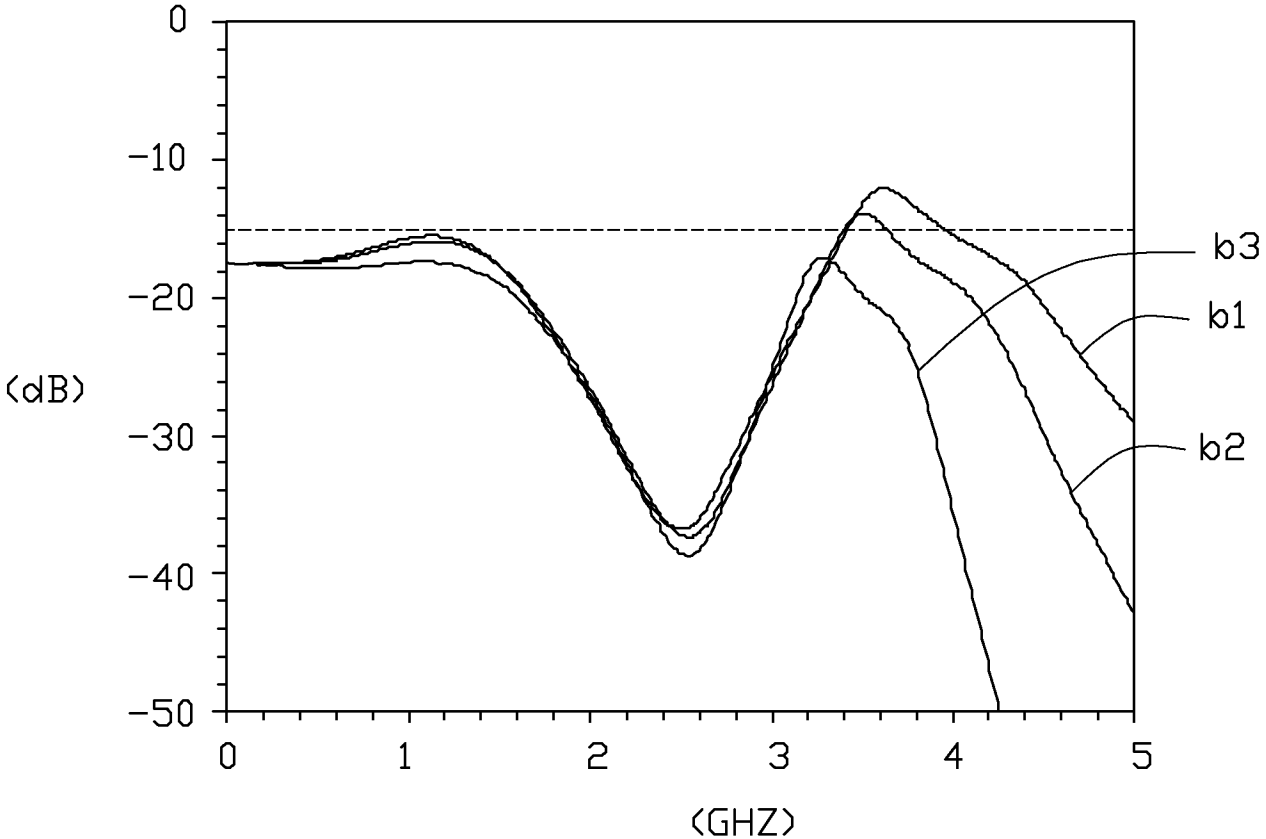
FIG. 7 is a simulation graph of insertion loss of a common-mode input for the signal transmission apparatus of FIG. 1.

FIG. 6 is a graph showing an insertion loss of a difference-mode input for the differential pair 40. FIG. 7 is a graph showing an insertion loss of a common-mode input for the differential pair 40. Where a1 and b1 represent simulation results of the differential pair 40 in a condition that the transmission line 41 mirrors the transmission line 42; a2 and b2 represent simulation results of the differential pair 40 in a condition that 1.5 mm displacements of the two sections of each of the section pairs Z1, Z3, and Z5 are formed in opposite directions from the initial positions along the width of the transmission lines 41, 42; and a3 and b3 represent simulation results of the differential pair 40 in a condition that the displacements are 3 mm.

It can be determined from FIG. 6 that required frequency bandwidth of the differential pair 40 can be achieved at a gain of −3 dB, and the frequency bandwidth can be raised from 2.2 GHZ to 2.38 GHZ when the 3 mm replacements of the two sections of each of the section pairs Z1, Z3, and Z5 are formed in opposite directions from the initial positions along the width of the transmission lines 41, 42. A required performance of difference mode signal transmission is achieved in a frequency band from 0 GHZ to 3 GHZ since the corresponding gain values are close to zero. It can be determined from FIG. 7 that common noise can be suppressed efficiently in a frequency band from 0 GHZ to 5 GHZ since most of the corresponding gain values are less than −15 dB. As shown by the curve b3, the gain values of the loss of the common input for the differential pair 40 is less than −15 dB when the 3 mm displacements of the two sections of each of the section pairs Z1, Z3, and Z5 are formed in opposite directions from the initial positions along the width of the transmission lines 41, 42.

The differential pair 40 transmits signals in cooperation with the ground sheets 11*a*, 1*ab*, 21*a*, 21*b*, 31*a* and 31*b*. In other embodiments, the differential pair 40 can transmit signals without cooperating with the ground sheets 11*b*, 21*b*, and 31*b*. The signal transmission apparatus 1 can be used in wireless transmission devices, such as wireless network card and access point. The signal transmission apparatus 1 can also be used in wired transmission devices.

The foregoing description of the exemplary embodiments of the disclosure has been presented only for the purposes of illustration and description and is not intended to be exhaustive or to limit the disclosure to the precise forms disclosed. Many modifications and variations are possible in light of the above everything. The embodiments were chosen and described in order to explain the principles of the disclosure and their practical application so as to enable others of ordinary skill in the art to utilize the disclosure and various embodiments and with various modifications as are suited to the particular use contemplated. Alternative embodiments will become apparent to those of ordinary skills in the art to which the present disclosure pertains without departing from its spirit and scope. Accordingly, the scope of the present disclosure is defined by the appended claims rather than the foregoing description and the exemplary embodiments described therein.

What is claimed is:

1. A signal transmission apparatus comprising:

a first circuit layer, a first ground sheet and a second ground sheet, each comprising a rectangular area, and being arranged in the first circuit layer;

a second circuit layer, a third ground sheet and a fourth ground sheet, each comprising a rectangular area and being arranged in the second circuit layer;

a fifth ground sheet and a sixth ground sheet arranged in a common surface between the first and second circuit layers; and a differential pair comprising a first transmission line arranged between the first circuit layer and the common surface of the fifth and sixth ground sheets, and a second transmission line arranged between the second circuit layer and the common surface of the fifth and sixth ground sheets;

wherein the first to sixth ground sheets are parallel to a signal transmission direction of the differential pair, the first to sixth ground sheets have same electric potentials, projections of the rectangular areas of the first and third ground sheets on the fifth ground sheet superpose a first border of the fifth ground sheet, the fifth ground sheet is formed by extending the first border along the signal transmission direction, projections of the rectangular areas of the second and fourth ground sheets superpose a second border of the sixth ground sheet, the sixth ground sheet is formed by extending the second border toward the fifth ground sheet, the differential pair comprises a plurality of section pairs, each of the plurality of section pairs is composed of two sections arranged in the first and second transmission lines symmetrically, each adjacent pair of the plurality of section pairs are equivalent to a capacitor and an inductor;

wherein each of the first and second ground sheets further comprises two extended areas that extend along the signal transmission direction from two opposite sides of the corresponding rectangular area, each of the third and fourth ground sheets further comprises two extended areas that extend along an opposite direction of the signal transmission direction from two opposite sides of the corresponding rectangular area.

2. The signal transmission apparatus of claim 1, wherein an input terminal of the differential pair is arranged between the first and third ground sheets, and an output terminal of the differential pair is arranged between the second and fourth ground sheets.

3. The signal transmission apparatus of claim 2, wherein the plurality of section pairs are arranged between the input terminal and the output terminal of the differential pair.

4. The signal transmission apparatus of claim 1, wherein a projection of the first ground sheet superposes the third ground sheet, a projection of the second ground sheet superposes the fourth ground sheet, the first to fourth ground sheets are identical structures.

5. The signal transmission apparatus of claim 4, wherein the first, third, and fifth ground sheets are electrically connected by first and second through holes, the second, fourth, and sixth ground sheets are electrically connected by third and fourth through holes, each of the first and second through holes passes through a corresponding one of said two extended areas of the first ground sheet, the fifth ground sheet, and a corresponding one of said two extended areas of the third ground sheet vertically, each of the third and fourth through holes vertically passes through a corresponding one of said two extended areas of the second ground sheet, the sixth ground sheet, and of the fourth ground sheet.

6. The signal transmission apparatus of claim 1, wherein the fifth and six ground sheets are symmetrically arranged in the common surface, and are rectangular in shape.

* * * * *